United States Patent [19]

Bonnett

[11] Patent Number: 5,069,554

[45] Date of Patent: Dec. 3, 1991

[54] "TABLECLOTH" DISPOSAL SYSTEM

[76] Inventor: Geroge M. Bonnett, 5718 St. Charles Ave., New Orleans, La. 70115

[21] Appl. No.: 471,786

[22] Filed: Jan. 29, 1990

[51] Int. Cl.[5] ..... B65D 30/20

[52] U.S. Cl. ..... 383/4; 53/413; 108/90; 493/225; 383/75; 383/120

[58] Field of Search ..... 383/4, 2, 120, 75; 108/90; 493/225; 53/413, 465

[56] References Cited

U.S. PATENT DOCUMENTS

| | | | |
|---|---|---|---|
| 2,777,491 | 1/1957 | Ashton et al. | 150/11 |
| 2,975,863 | 3/1961 | Sosnowich | 183/51 |
| 3,204,855 | 9/1965 | Boynton et al. | 229/53 |
| 3,291,373 | 12/1966 | Joyce | 383/120 |
| 3,495,762 | 2/1970 | Verbic | 383/2 |
| 3,653,583 | 4/1972 | Meyer | 229/54 C |
| 3,676,887 | 7/1972 | Klein | 15/104.8 |
| 3,739,418 | 6/1973 | Yonaites et al. | 15/104.8 |
| 3,806,984 | 4/1974 | Hilsabeck | 15/257.7 |
| 3,825,050 | 7/1974 | Glover | 108/90 |
| 4,337,812 | 7/1982 | Trinkner | 383/75 |
| 4,471,600 | 9/1984 | Dunleavy | 53/468 |
| 4,500,129 | 2/1985 | Hahn | 383/4 |
| 4,558,463 | 12/1985 | Boyd | 383/75 |
| 4,938,607 | 7/1990 | Kelley | 383/75 |

*Primary Examiner*—Stephen P. Garbe
*Attorney, Agent, or Firm*—C. Emmett Pugh

[57] ABSTRACT

A disposal system comprising a temporary, disposal work surface covering of substantially flat, flexible sheet material, such as extruded plastic or the like, having cinch means incorporated therein. While the preferred embodiment of the present invention is exemplified as a disposable tablecloth, the invention is useful in a variety of applications, including lawn care, garbage collection, and any use which requires traditional garbage bags, but at a significant decrease in disposal effort and expense. An alternative embodiment of the invention teaches a tablecloth or the like having a upwardly extended, peripherally surrounding, raised edge areas for preventing liquids from spilling onto the users. Likewise, incorporated therein is a cinch strap system for enveloping the contained refuse. The lifted or raised edge as contemplated may comprise merely a plastic ridge, or, preferably, a multitude of "accordion" folds formed from the plastic sheeting forming the main, centrally located surface of the device, with the cinch strap system being incorporated into the top of the fold area. The present invention is particularly suitable for utilization as a tablecloth in conjunction with the consumption of seafoods such as crayfish, crabs, oysters, shrimp and the like, which generate a large amount of refuse during the meal. The system as disclosed allows disposal of the tablecloth, simultaneously creating a container for disposal of the contents. When cinched, the present invention may be handled as a conventional plastic garbage bag, and therefore does not require a separate garbage container for disposal.

13 Claims, 2 Drawing Sheets

"TABLECLOTH" DISPOSAL SYSTEM

BACKGROUND OF INVENTION

1. Field of Invention

The present invention relates to disposal methods and apparatus and more particularly to a disposal system comprising a substantially flat, flexible material such as extruded plastic or the like having cinch means incorporated therein. While the preferred embodiment of the present invention is exemplified as a "table cloth," the invention is useful in a variety of applications, including lawn care, garbage collection, and any use for which standard type, plastic garbage bags can be used, but at a significant decrease in effort and expense.

An alternative embodiment of the invention teaches a table cloth or the like having a lifted, or raised edge, peripheral area for preventing liquids from spilling off of the sheet onto the users. Likewise, incorporated therein is cinch means for forming of the theretofore flat sheet into a bag-like for the disposing of the contained refuse.

The lifted edge as contemplated in the above embodiment may comprise merely a plastic ridge, or, preferably, a multitude of plastic "accordion" folds, wherein the cinch means lines the top of the fold area.

The present invention is particularly suitable for utilization as a tablecloth in conjunction with the eating of seafoods, such as, for example, crawfish, crabs, oysters, shrimp and the like, which generate a large amount of refuse during the meal. The system as disclosed allows disposal of the tablecloth, simultaneously creating a container for the disposal of the contents.

When cinched, the present invention may be handled like a conventional plastic garbage bag, and therefore does not require a separate garbage container for disposal.

2. Prior Art & General Background

While the prior art has apparently contemplated a method and/or apparatus for the utilization of a cinch or drawstring in conjunction with plastic garbage bags, it has not taught a device suitable for use as a table cloth or related application which might be disposable, and concurrently dispose of waste placed atop it. In fact, the below cited prior patents have not even remotely contemplated such a device. The prior art is apparently limited to bag-type structures.

Virtually all of the flexible garbage containers in the prior art, which incorporated cinch closing means, comprised a bag of sorts, unlike the present invention, which lies completely flat when opened, allowing less laborious placing of the garbage in and on the containment area.

A list of prior patents which may be of interest is presented below:

| Patent No. | Patentee(s) | Issue Date |
|---|---|---|
| 2,777,491 | G. Ashton et al | Jan 15, 1957 |
| 2,975,863 | M. Sosnowich | March 21, 1961 |
| 3,204,855 | I. D. Boyton et al | Sept. 7, 1965 |
| 3,653,583 | Meyer | Apr 4, 1972 |
| 3,676,887 | Klien | July 18, 1972 |
| 3,739,418 | Yonaites et al | June 19, 1973 |
| 3,806,984 | Hilsabeck | Apr. 30, 1974 |
| 4,471,600 | Dunleavy | Sep 18, 1984 |
| 4,558,463 | Boyd | Dec 10, 1985 |

As evident from a review of the above patents, the prior art has failed to conceive a tablecloth or like device which includes cinch means for allowing containment of any garbage or other item placed upon it.

Further, the prior art has not contemplated a table cloth or the like which incorporates an elevated periphery area for the prevention of spillage of beverages and fluid extricated from, for example, seafood during eating, as well as cinch means for containing any refuse left on the table once the meal is completed. Of course, this embodiment has other uses as well, including, for example, retaining fluids under an automobile during repair, carpentry, and any other application which requires the containment of particulates, liquids, or small debris.

For example, U.S. Pat. No. 4,471,600 issued 1984 teaches a "Leaf Bagging Equipment and Method," wherein a leaf collecting and bagging assembly is made up of a plastic bag having an open end and sheet means attached to the opening, the sheet designed to "guide" leaves and the like into the opening of the bag for containment.

U.S. Pat. No. 3,653,583 issued 1972 teaches a "Drawcord Bag" made of plastic having drawcords about the periphery of the opening of the bag for the containment of waste garbage and the like.

None of the above cited prior art patents are usable in the method contemplated in the present invention. Further, except for the common utilization of cinch means, the prior art is unrelated in construction to that contemplated in the present invention. Until the advent of the present invention, there was apparently no device designed for the clean, convenient, and economical disposal of foods with a large percentages of throw away material, such as, for example, crawfish, shrimp, crabs, and the like.

3. General, Summary Discussion of the Invention

The present invention overcomes these prior art problems by providing a system which is highly reliable, relatively economical and very cost effective.

The present invention comprises a flexible, substantially flat cover of plastic or the like, with cinch means incorporated in its periphery, allowing the theretofore, substantially flat cover to form a bag-like container when cinched for items theretofore placed upon it when flat, whether the cover is used as a tablecloth, dust cover, or in many other possible uses too numerous to list.

In contrast to the prior art, cinched, garbage bag, which must be held and opened up for debris to be effectively contained within it, in the present invention the temporary, disposable cover is placed on the work surface in a substantially flat disposition and the debris is then placed on it when in its flat disposition. Only when it is desired to dispose of the covering and its associated debris, is the sheet device cinched up to effectively form a bag-like configuration. Again, in contrast to the standard, prior art, plastic bag, which when laid flat has a two wall thickness, the sheet device of the present invention typically would have only a single wall or layer thickness, with the two wall thickness of the prior art garbage bag being separable when the bag is opened for use, while any multiple layers in the sheet device of the invention typically would not being separable.

An alternative embodiment of the invention teaches "spillproof" means in the form of a raised, surrounding periphery incorporated in conjunction with the cinch means. The raised periphery may be made via multiple folds in an "accordion" manner, or may comprise the implementation of a raised member, including the cinch itself, into the peripheral lining of the cover.

The alternative embodiment is particularly suitable for use as a tablecloth in conjunction with the consumption of seafood, such as crawfish, crabs and the like, which expel large amounts of juices when peeled. During cleanup, the cinched member need only be pulled in an upward fashion, allowing the tablecloth to envelope and contain the shells, juices, et cetera, remaining. This alternative embodiment is also appropriate for use at children's parties, where there is a high likelihood of beverages being spilled thereon.

It is thus an object of the present invention to provide an apparatus and method for conveniently covering an area and providing means to envelope and contain refuse placed thereon.

It is a further object of the present invention to provide a disposable table cloth incorporating cinch means therein.

It is still a further object of the present invention to provide a disposable table cloth having cinch means and means to prevent beverages and other fluids from spilling.

Lastly it is an object of the present invention to provide a system for disposing of refuse and the like utilizing a cinched cover area upon which the refuse is placed.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EXEMPLARY EMBODIMENTS

Figure 1:
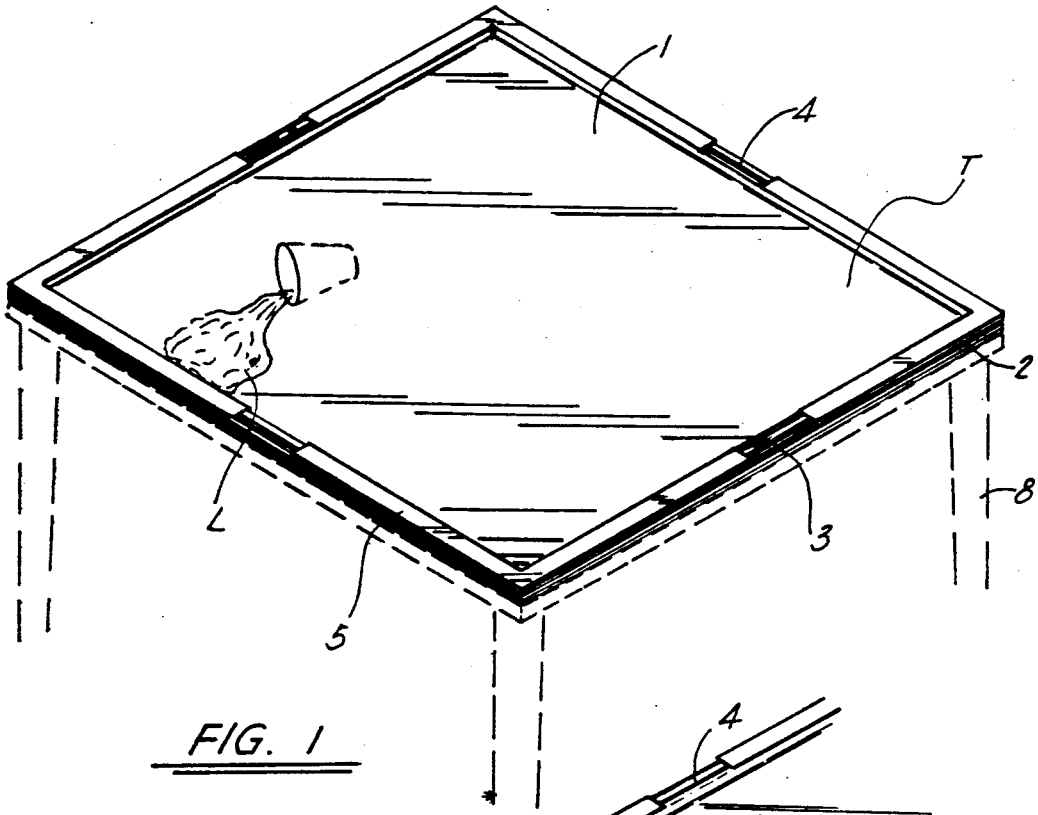
FIG. 1 is an isometric view of the exemplary, preferred embodiment of the disposal system of the present invention, illustrating the preferred "tablecloth" embodiment.

As can be seen in FIG. 1, the exemplary "tablecloth" disposal system of the preferred, exemplary embodiment of the present invention, includes a substantially flat sheet 1 of flexible, fluid impermeable material, such as, for example, extruded, low density polyethylene film, configured to temporarily cover a work surface, such as, for example, a table top or portion of ground. In the present figure, the "tablecloth" T forms a substantially flat cover over a table 8, with its peripherally surrounding, raised edges preventing a spilled beverage L from spilling off of the table unto the eaters or other users or unto the floor. The sheet 1 maintains its substantially flat disposition as it is used as a covering and debris is placed upon it.

The edges of the rectangular sheet 1 preferably are configured to form a raised or upwardly extended, peripheral areas 2 joined at the four corners or edges to completely surround the centrally located, flat surface area of the sheet to prevent the beverage or liquid L from escaping. This embodiment contemplates a raised border area 2 provided by, for example, several folds formed in the sheet 1 at its peripheral edges in an accordion-like manner, one fold on top of the preceding one. Thus, the raised area 2 unfolds when lifted for more efficient containment of fluids, particulate matter such as sawdust, seafood refuse, and the like.

Figure 4:
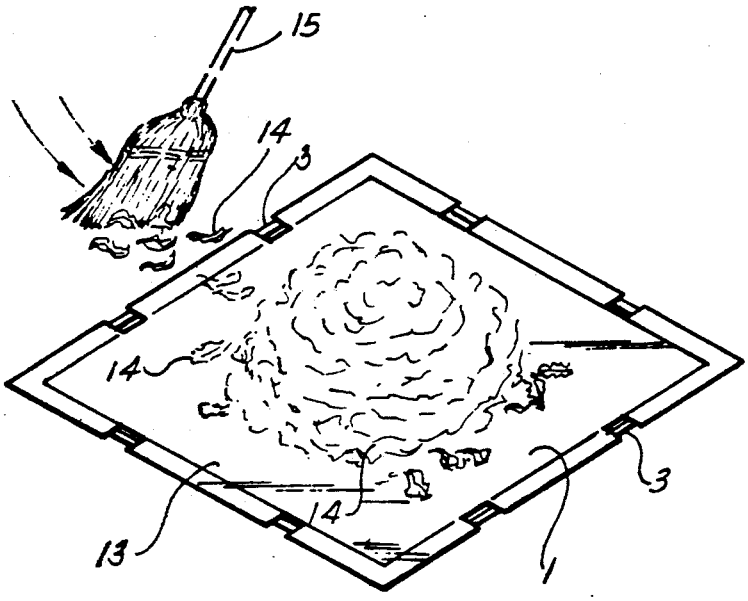
FIG. 4 is a side, perspective, partially cutaway view of the "tablecloth" embodiment of the present invention, illustrating in detail the cinch means.

Encompassing the upper periphery 5 of the raised border area 2 is cinch strap 3 formed to slidingly engage the border area 2. The cinch 3 is substantially enveloped by a heat-sealed fold 11, which is illustrated in greater detail in FIG. 4. As illustrated in FIG. 4, the heat-sealed fold 1 in the present embodiment comprises the sheet material of border area 2 folded over and heat sealed to form seam 10 and tube 9, within which is extended the cinch strap or piece 3. Each open area 4 may also be sealed at its edges for reinforcement via a seam 12.

Figure 2:
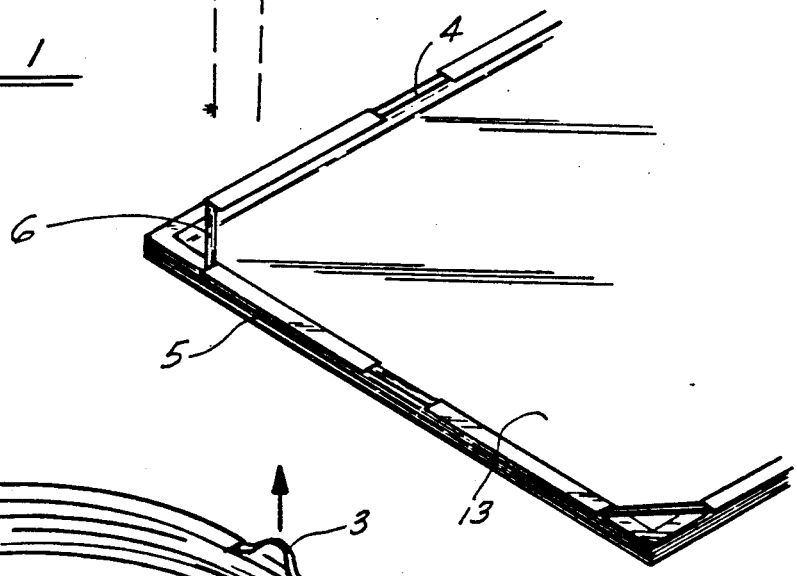
FIG. 2 is an isometric, partial view of the "tablecloth" embodiment of the present invention, further illustrating the raised edges but with corner cinches as a supplement to (or in substitution of) the middle cinches, as an alternate for the embodiment of FIG. 1.

Returning to FIG. 1, cinches 3 may be placed in the middle periphery of edges 5, or may be configured to openly engage the corners of the rectangular device, as illustrated with the cinched corners 6 of the alternate embodiment illustrated in FIG. 2. Upon completion of the use of the sheet 1 as a temporary, disposable covering, the cinch piece 3 is drawn up at the open areas 4, in effect forming a garbage bag out of the theretofore flatly disposed sheet, for its ultimate disposal with its contained debris, including any contained liquids.

Figure 3:
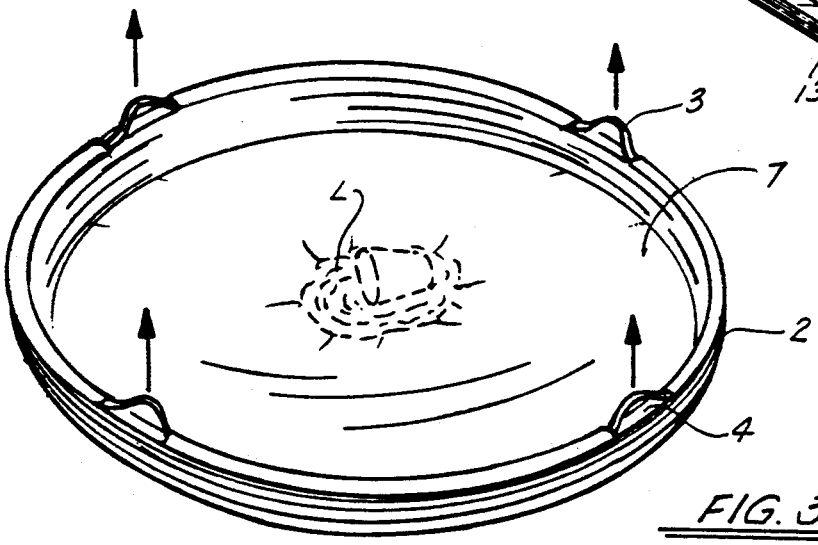
FIG. 3 is a isometric view of an alternative embodiment of the present invention, illustrating the present invention in a circular configuration and showing the cinch means and raised edges.

FIG. 3 illustrates still another, alternative embodiment of the present invention, a circularly configured system 7 having a single, peripherally surrounding or encircling, folded, raised edge 2. This system is designed for use as a temporary disposable cover for a round table or the like, or in any other uses which would require the covering of any object, while simultaneously containing liquids or other like debris which might be spilled or poured upon it.

Like the above embodiments, lifting, raised edges 2 via cinches 3 allows the edges 2 to unfold, providing further containment. The directional arrows in FIG. 3 indicate the direction that the cinch strap or piece 3 may be pulled from the openings 4 to form the theretofore flat sheet into a bag-like disposition.

Although the embodiments of FIGS. 1 and 3 could be sized to cover the complete table top surface, as shown for the table 8 illustrated in FIG. 1, alternatively they could be downsized to provide place-mat-type, individual table area covers for individual users, if so desired.

Figure 6:
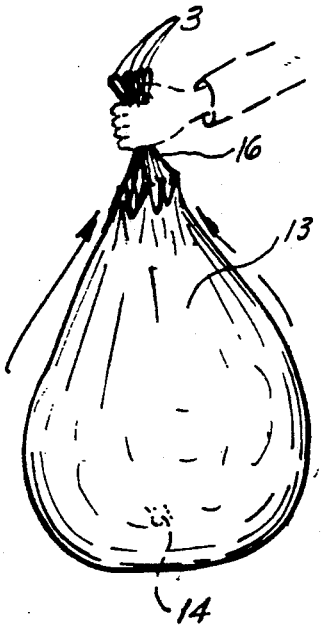
FIG. 6 is a side view of an exemplary embodiment of the present invention with the cinch pulled, forming a container, and illustrating the contained debris in phantom.
Figure 5:
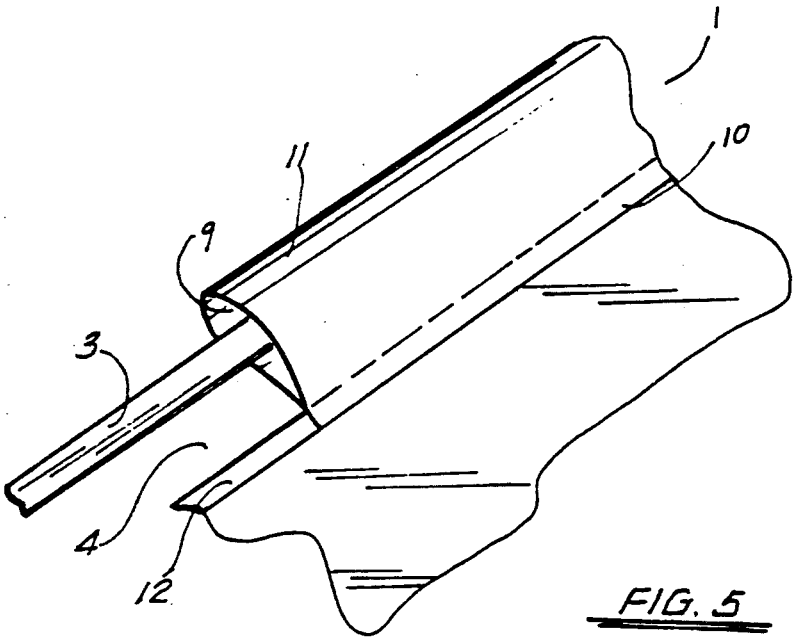
FIG. 5 is an isometric view of a further, alternative embodiment of the present invention, as used in conjunction with the sweeping or raking of debris.

FIGS. 5 and 6 show the present system used in conjunction with outdoor sweeping or raking operations, illustrating the placement and containment of, for example, leaves 14. As in all of the embodiments the main, centrally located surface of the sheet 1 lies flat on the work surface as the debris is placed on it. In FIG. 5, leaves 14 are merely raked (note 15) upon the plastic sheet 1 away from the edges 2A toward the center 13. This operation is easily performed by a single individual, as opposed to having to rake the leaves 14 into a standard, prior art type lawn bag, which entails a much more cumbersome operation.

After, for example, a medium size pile of leaves 14 has been placed upon the plastic sheet, the cinch strap 3 is pulled from the various openings 4 in an upward matter, and the exposed cinch loops 16 are then tied together, as illustrated in FIG. 6. While the container then has the convenience and general appearance of a conventional plastic lawn bag in FIG. 6, it does not require the cumbersome loading operation associated with the old leaf bag.

As noted, this improved operation may easily be performed by a single individual, with greater speed and efficiency than the old method.

An alternative means of providing a raised edge with the present system may be accomplished by utilizing a cinch of greater diameter than the plastic drawstring contemplated in the above embodiments. For example, a nylon rope of, for example, one-half (½) inch diameter would satisfactorily serve to raise the edges of the sheet substantially or significantly, thereby preventing the runoff of liquids that might be spilled upon it.

The embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A disposable, temporary covering, such as a tablecloth or the like, for a work surface, such as a table top or the like, which device includes containment means to contain debris placed upon it, comprising:

a flexible sheet which has a main, centrally located surface upon which debris is placed for ultimate disposal and which lies flat in use on the work surface as the debris is placed on it and having at least one, peripherally surrounding edge, said peripherally surrounding edge being raised, extending above the main surface of said sheet a significant distance sufficient to contain liquids spilled upon said main surface, said raised peripherally surrounding edge being formed by a plurality of accordion-type folds; and cinch means included with said sheet slidingly engaging said peripherally surrounding edge of said flexible sheet for drawing together said peripherally surrounding edge of said flexible sheet forming a container for the debris.

2. The disposable covering of claim 1, wherein said sheet is rectangular in configuration and wherein said peripherally surrounding edge is comprised of four, joined, peripheral edges.

3. The disposable covering of claim 1, wherein said sheet is circular in configuration and wherein said peripherally surrounding edge is comprised of one, continuous, encircling edge.

4. The disposable covering of claim 1, wherein said sheet is comprised of low density polyethylene film.

5. The disposable covering of claim 4, wherein said sheet is extruded.

6. The disposable covering of claim 1, wherein said cinch means is formed along the upper periphery of said raised peripherally surrounding edge.

7. The disposable covering of claim 6, wherein said raised peripherally surrounding edge is formed by said cinch means.

8. The disposable covering of claim 1, wherein:

the top of one of said series of accordion-like folds forming a tube through which said cinch piece is extruded and which is exposed at spaced, open areas in said tube in the top one of said accordion-like folds of said raised edge, allowing said cinch piece to be grabbed through said open areas for cinching the peripheral edge of the covering together, forming in effect a bag containing the debris for its ultimate disposal.

9. A method of fabricating a disposable, temporary covering, such as a tablecloth or the like, having containment means for containing debris placed upon it, comprising the following steps:

(a) extruding a flexible plastic sheet having at least one edge;

(b) forming at least one fold along the edge of said sheet;

(c) sealing the bottom of said fold to said sheet to form a tubular partition along the edge of said sheet;

(d) folding said edge to form accordion folds producing a raised edge area;

(e) cutting open areas in said tubular partition, and (f) placing a strap in said tubular partition, forming a cinch strap, which is engaged at the open areas.

10. The method of claim 9, wherein there is further included the step of:

folding said raised edge area in such a manner as to have said cinch strap exposed along the top of said raised edge.

11. A disposable, temporary, tablecloth-like covering for temporarily covering a table top surface or the like, which device includes containment means to contain debris placed upon it, comprising:

a flexible, substantially flat sheet which has a main, centrally located surface upon which debris is placed for ultimate disposal and which lies flat in use on the table top surface as the debris is placed on it and having a peripherally extending, raised edge surrounding said centrally located surface, said raised edge being formed from a series of accordion-like folds, one on top of the preceding one, with the top one forming a tube through which a cinch piece may be extended and which is exposed at spaced, open areas in said tube in the top one of said accordion-like folds of said raised edge, allowing said cinch piece to be grabbed through said open areas for cinching the peripheral edge of the covering together, forming in effect a bag containing the debris for its ultimate disposal; and cinch means included within said tube of said sheet slidingly engaging the peripherally extending edge of said flexible sheet for drawing together the peripheral of said flexible, theretofore flat sheet forming a container for the debris.

12. The disposable covering of claim 11, wherein said sheet is rectangular in configuration and wherein said peripherally surrounding edge is comprised of four, joined, peripheral edges.

13. The disposable covering of claim 11, wherein said sheet is circular in configuration and wherein said peripherally surrounding edge is comprised of one, continuous, encircling edge.

* * * * *